United States Patent [19]

Sgroi

[11] 4,094,357

[45] June 13, 1978

[54] HEAT TRANSFER BLANKET

[75] Inventor: Ronald Sgroi, Syosset, N.Y.

[73] Assignee: Kenneth C. McCord, Bethpage, N.Y.

[21] Appl. No.: 675,301

[22] Filed: Apr. 9, 1976

[51] Int. Cl.[2] ..... F28D 15/00; A47C 19/00; H05B 1/00

[52] U.S. Cl. ..... 165/105; 5/284; 128/403; 165/46; 219/212

[58] Field of Search ..... 165/46, 105; 219/211, 219/212; 5/284; 128/399, 401, 402, 403

[56] References Cited

U.S. PATENT DOCUMENTS

| | | | |
|---|---|---|---|
| 1,211,606 | 1/1917 | McDonald | 165/130 |
| 2,753,435 | 7/1956 | Jepson | 165/46 X |
| 2,978,225 | 4/1961 | Dallas, Jr. | 165/46 |
| 2,991,627 | 7/1961 | Suits | 165/46 X |
| 3,233,662 | 2/1966 | Yuen | 128/403 |
| 3,347,309 | 10/1967 | Redding et al. | 165/105 X |
| 3,438,069 | 4/1969 | Long | 5/284 |
| 3,604,503 | 9/1971 | Kusianovich et al. | 165/105 X |
| 3,604,504 | 9/1971 | Hess et al. | 165/105 |
| 3,680,189 | 8/1972 | Noren | 165/105 X |
| 3,738,702 | 6/1973 | Jacobs | 165/105 X |
| 3,780,537 | 12/1973 | Spencer | 165/46 X |
| 3,951,127 | 4/1976 | Watson et al. | 128/399 |
| 3,955,618 | 5/1976 | Asselman et al. | 165/105 |

FOREIGN PATENT DOCUMENTS

| | | | |
|---|---|---|---|
| 651,873 | 9/1937 | Germany | 237/71 |
| 276,093 | 10/1970 | U.S.S.R. | 165/105 |

*Primary Examiner*—Charles J. Myhre
*Assistant Examiner*—Sheldon Richter
*Attorney, Agent, or Firm*—Robert D. Farkas

[57] ABSTRACT

This disclosure pertains to a blanket having a plurality of portions of flexible heat pipes sandwiched between the outermost layers thereof. The portions of the flexible heat pipes disposed about the blanket provide a uniform heating or cooling pattern therein. The ends of the flexible heat pipes that are free from the blanket are thermally coupled to a combination heating and cooling system. When utilizing the heating system, the flexible heat pipes provide elevated temperatures at the blanket surfaces. When utilizing the cooling system, the flexible heat pipes provide lower than ambient temperatures at the blanket surfaces.

5 Claims, 4 Drawing Figures

FIG. 1
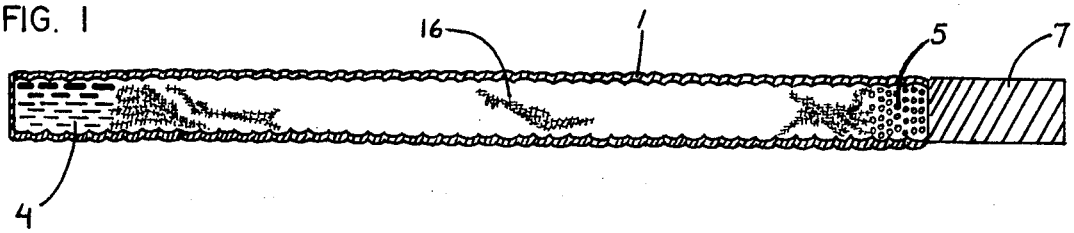
FIG. 2
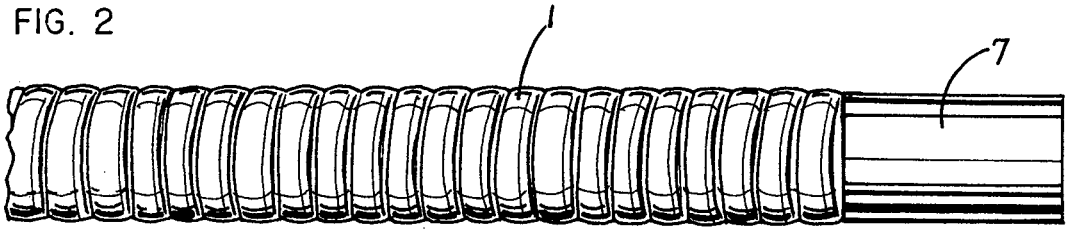
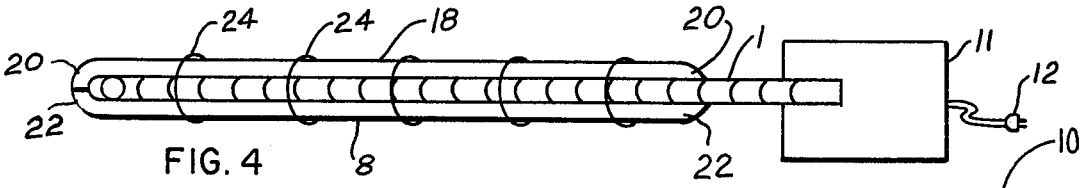
FIG. 4
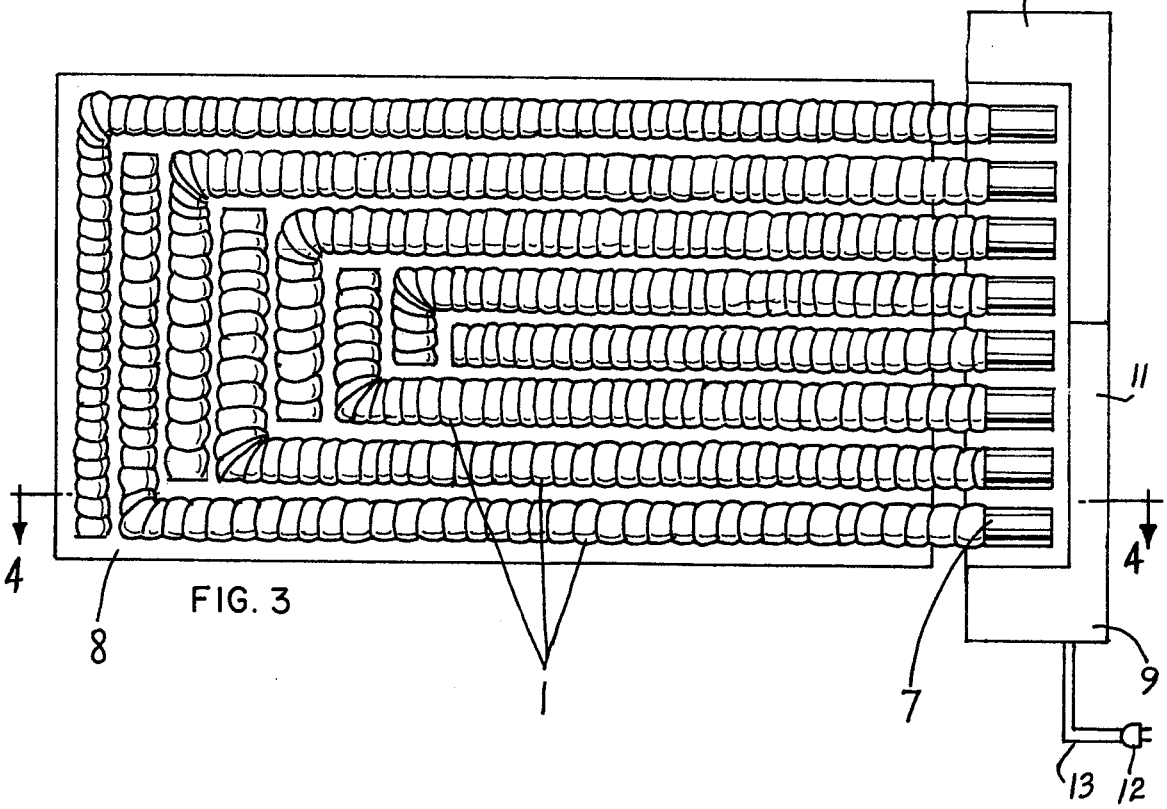
FIG. 3

HEAT TRANSFER BLANKET

BACKGROUND OF THE INVENTION

1. THE FIELD OF THE INVENTION

This invention relates to blankets that are thermally conditioned utilizing external power sources therefor.

2. DESCRIPTION OF THE PRIOR ART

The prior art abounds with apparatus utilized to forcibly induce thermal changes in the operation of blankets and air spaces. The standard electric blanket employs a plurality of resistance wires interspersed between the outermost layers of the blanket, utilizing electrical energy to produce heating effects within the wires. Air conditioned tents such as disclosed in U.S. Pat. No. 3,885,571 issued on May 27, 1975 to C. C. Sach and U.S. Pat. No. 2,220,447 issued on Nov. 5, 1940 to F. W. Hartman modify the air temperature of a forced oxygen system for use with patients requiring a cool, moist, and oxygenated atmosphere. The aforesaid patents require the patient or user to be totally enclosed within a chamber. There is no device which can alternatively heat and cool the user by employing an apparatus that can thermally contact selective portions of the body.

SUMMARY OF THE INVENTION

A primary object of the instant invention is to provide a blanket which may be utilized for both heating and cooling the user.

Another object is to provide a blanket completely devoid of electrical hazards.

Still another object is to provide a blanket which may be washed or dry cleaned without fear of deteriorating the thermal elements therewithin.

Yet another object is to provide a blanket whose heating or cooling source is remote from the blanket itself.

Heretofore, thermal coupling from a cooling source to the interior of an oxygen tent utilized a flow of gas the medium of heat exchange. The heat transfer efficiency is low and can only be increased by increasing the volume of gas employed or the temperature differential of the gas employed.

A heat pipe utilizes the latent heat of vaporization and fusion of a volatile liquid to effectively couple the temperature deviations experienced at one end to the other end thereof. A flexible heat pipe, utilizing a spirally wound flexible sheath is employed in the instant invention by securing the greater portion of the length thereof between the surfaces of a blanket. The exposed end of the flexible heat pipe is coupled to a combination electrically operated heating and cooling device, which generates a heat source modifying the temperature at the free end of the heat pipe.

Thus, no noise is generated, as in the case of an oxygen tent, nor is the user subject to the risk of electrical shock, as in the case of an electric blanket. The blanket contains a plurality of heat pipe lengths therewithin, disposed in a uniform pattern, covering effectively, the entire useful surface area of the blanket.

These objects, as well as other objects of the present invention, will become readily apparent after reading the following description of the accompanying drawings.

BRIEF DESCRIPTION OF THE DRAWINGS

FIG. 1 is a side elevation view of a flexible heat pipe illustrating the interior portions thereof.

FIG. 2 is a side elevation view of a heat pipe showing the flexible sheath thereof.

FIG. 3 is a plan view of a plurality of heat pipes secured to a flexible, fabric-like, layer of a blanket and a power source supplying cooling or heating energy to the free ends of the heat pipes employed.

FIG. 4 is a side elevation view, taken through line 4 — 4 viewed in the direction of arrows 4 — 4 of the apparatus shown in FIG. 3.

DESCRIPTION OF THE PREFERRED EMBODIMENT

The structure and method of fabrication of the present invention is applicable to a pair of juxtaposed rectangularly shaped fabric sheets having a plurality of flexible heat pipes disposed in an overall pattern thereinbetween. The heat pipes comprise a volatile liquid and a wick disposed within a flexible metallic sheath such that the heat transfer is dependent upon the phase state of the volatile material.

A combination heating and cooling system is situated at a remote location to one edge of the blanket formed by the two flexible fabric sheets. The heat pipes extend from the edge of the blanket to the stationary source of thermal energy. An electrically operated heat generator and alternatively, a refrigeration device, supplies thermal energy to the free ends of the heat pipes thermally coupled thereto. Conventional means, well known to the art, provide a constant source of heat energy to large thermal masses, fabricated from solid rods of metal, affixed to each free end of each heat pipe coupled to the source of thermal energy, thereby insuring, adequate thermal coupling and satisfactory temperature stability throughout the blanket proper.

Now referring to the Figures, and more particularly to the embodiment illustrated in FIG. 1 showing a flexible metallic heat pipe having a metallic sheath 1. A solid metallic rod 7 is affixed to one end of the pipe. Wick 16 extends the entire length of the interior of the pipe which is partially filled with a liquid 4 that becomes a vapor 5 upon sufficient heating. The end of the pipe in which liquid 4 is situated accepts heat from the surrounding area, causing the liquid to vaporize. The vapor ultimately communicates with the other end of the pipe, as denoted by numeral 5. At this end, cooling effects are introduced and the vapor condences back to a liquid state, which travels along the wick 16 to the end of the tube containing the liquid 4. The efficiency of thermal coupling between opposite ends of the heat pipe is substantially higher than the coupling efficiency of an equivalent diameter and length of a solid copper rod.

FIG. 2 illustrates a heat pipe having a metallic sheath 1 whose surface is adapted with an overwrap of a continuous strip material, thereby insuring that the undulations 6 permit the sheath to be flexible and liquid tight. Ferrule end 7, composed of a solid metallic rod, provides a convenient clamping surface to a source of thermal energy.

FIG. 3 illustrates a number of flexible heat pipes 1 disposed in a suitable overall pattern about the surface of a fabric layer 8 constituting a portion of a blanket, not shown. Metallic ends 7 are fitted to a combination source of thermal energy 9 containing therewithin a refrigeration cooled apparatus 10 and a heating apparatus 11 of conventional design well known in the art. Line cord 13 is adapted with an electrical plug 12 utilized to provide electrical energy to the combination heating and cooling apparatus. The user utilizes the blanket, not shown, in conventional fashion and when desired, operates either the refrigeration cooled apparatus 10 in warm weather or the heating apparatus 11 in cold weather utilizing a thermostatic control, not shown, to maintain the desired temperature at the area in which thermal rods 7 are situated.

FIG. 4 shows fabric layer 8 disposed covered by fabric layer 18. Heat pipe 1 is shown having end 7 thereof secured to heating apparatus 11. Marginal edges 20 of fabric layer 18 are shown disposed overlying marginal edges 22 of fabric layer 8. Stitches 24, well known in the art, secure fabric layers 8 and 18 together whilst securing heat pipe 1 thereto. All the heat pipes 1, shown in FIG. 3, are secured in like fashion between fabric layers 8 and 18.

One of the advantages is a blanket which may be utilized for both heating and cooling the user.

Another advantage is a blanket completely devoid of electrical hazards.

Still another advantage is a blanket which may be washed or dry cleaned without fear of deteriorating the thermal elements therewithin.

Yet another advantage is a blanket whose heating or cooling source is remote from the blanket itself.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

1. A heat transfer blanket comprising a plurality of flexible sheath heat pipes, a pair of juxtaposed fabriclike layers having the marginal edges of one of said pair substantially in intimate contact with the marginal edges of the other of said pair, a portion of the length of each of said heat pipes adjacent one end thereof fixedly secured to and between said fabric-like layers disposed in spaced apart relationship, said spaced apart relationship providing substantially uniform distances between adjacent heat pipes, the other end of said plurality of said heat pipes fixedly secured to a solid metallic rod, said rod in intimate thermal contact with a source of thermal energy.

2. The heat transfer blanket as claimed in claim 1 further comprising a thermostatic switch controlling the temperature of said source of thermal energy.

3. The heat transfer blanket as claimed in claim 1 wherein said source of thermal energy comprises a refrigeration cooled system and a heating system.

4. The heat transfer blanket as claimed in claim 1 wherein said source of thermal energy is operated by an electrical source of power.

5. The heat transfer blanket as claimed in claim 1 wherein said sheath comprises a metallic flexible hollow tube having both ends thereof closed.

* * * * *